United States Patent [19]

Birkeland et al.

[11] 3,935,969

[45] Feb. 3, 1976

[54] BUNG WITH SELECTABLE FLOW OPENINGS

[76] Inventors: Odd Thorbjörn Birkeland, Nedreveien 30, 4014 Vaulen; Finn Graaner, Harriet Backers vei 5, 4000 Stavanger, both of Norway

[22] Filed: Sept. 13, 1972

[21] Appl. No.: 288,537

[52] U.S. Cl. ..... 222/541; 217/111; 222/552

[51] Int. Cl.[2] ..... B65D 47/10

[58] Field of Search ..... 222/541, 552, 545; 217/98, 217/99, 110, 111

[56] References Cited

UNITED STATES PATENTS

| | | | |
|---|---|---|---|
| 2,325,356 | 7/1943 | Alvear | 217/111 |
| 2,946,491 | 7/1960 | Bramming | 222/552 X |
| 3,454,196 | 7/1969 | Hazard | 222/541 X |
| R4,852 | 4/1872 | Warth | 222/552 X |

*Primary Examiner*—Stanley H. Tolberg
*Assistant Examiner*—Larry H. Martin
*Attorney, Agent, or Firm*—Young & Thompson

[57] ABSTRACT

A bung screw-threadedly received in a receptacle has a plurality of flow openings therethrough disposed in a series about the axis of the bung, and an axially movable valve disc for simultaneously opening or closing all of the openings. Each opening has a thin penetrable closure which can be penetrated without disturbing any of the other closures. In this way, when the container is tilted to discharge the contents, only the closure of the flow opening which is lowermost need be broken. The disc can then be manipulated to open and close the bung, without the contents of the container flowing over the tools and the hands of the operator who opens and closes the disc.

4 Claims, 2 Drawing Figures

BUNG WITH SELECTABLE FLOW OPENINGS

Figure 1:
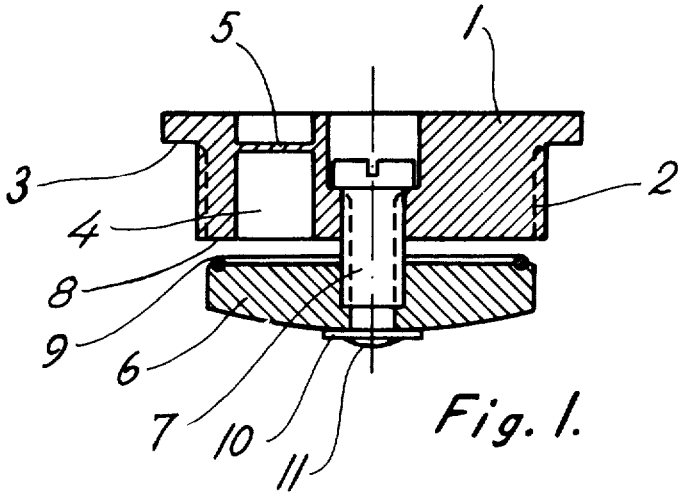

The present invention relates to bungs for containers, more particularly of the type having at least one opening therethrough and a disc or other valve member for opening and closing the flow opening while leaving the bung in the container.

Known bungs of this type are costly to produce. Moreover, when mounting the bung in the receptacle, it is necessary to make sure that the flow opening is at the bottom of the bung when the receptacle is tilted to empty the contents of the receptacle. Otherwise, the contents of the receptacle will pour out through the top of the bung, and will foul the tools and the hands of the operator who manipulates the bung to open and close it.

Another known bung of this type, shown in U.S. Pat. No. 2,946,491, is particularly adapted for small vacuum bottles and is shaped like a cup having a plurality of ports through the bottom thereof. A disc disposed below the bottom opens and closes all of the ports simultaneously. However, this device is not suitable for larger receptacles such as oil drums, as the contents of the drum would flow out through all the openings simultaneously, with the problem described above.

Accordingly, it is an object of the present invention to provide a bung of the type described, which need not be precisely positioned with respect to the container it closes.

Another object of the present invention is the provision of a bung which provides additional safety to the contents of the container before the bung is first used.

Still another object of the present invention is the provision of a bung which can be opened and closed without fouling the tools and hands of the operator.

Finally, it is an object of the present invention to provide a bung of the type described, which will be relatively simple and inexpensive to manufacture, easy to install and operate, and rugged and durable in use.

Briefly, the objects of this invention are attained by providing a bung having a plurality of flow openings therethrough arranged in a series about the axis of the bung, and a valve disc for simultaneously opening and closing all of the flow openings. Each flow opening has a thin penetrable closure which can be separately penetrated without disturbing any of the other closures. Only the closure which is lowermost when the container is tilted will be penetrated, so that only the contents of the container will leave through only the lowermost flow opening. Manipulation of the bung to open and close the disc can therefore be conducted entirely above the emergent stream of liquid, and the tools and hands of the operator will not become fouled with the contents of the container. Furthermore, the closures provide an auxiliary closure of the receptacle, in addition to the closure disc, prior to the rupture of any closure, so that even if the disc leaks, the bung will not.

Figure 2:
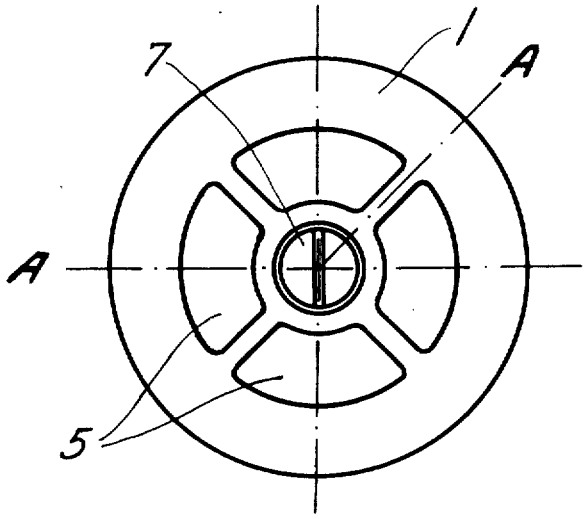

Other objects, features and advantages of the present invention will become apparent from a consideration of the following description, taken in connection with the accompanying drawing, in which:

FIG. 1 is an axial cross-sectional view of a bung according to the present invention, on the line A-A of FIG. 2; and FIG. 2 is a top plan view of the bung shown in FIG. 1.

Referring now to the drawing in greater detail, there is shown a bung 1 which has external screw threads 2 and a peripheral flange 3, for screw-threaded attachment in the usual way within the screw-threaded opening of a container such as an oil drum. If bung 1 is of a synthetic resin which is somewhat deformable, then it will not be necessary to provide a packing ring beneath flange 3 to secure the bung fluidtightly to the container.

Bung 1 has a plurality of flow openings 4 therethrough, arranged as shown in FIG. 2 in a series about the axis of the bung. These may for example be four in number, so that no matter what the rotated position of the bung relative to the container, one opening 4 will always be beneath that midplane of the bung which is most nearly horizontal.

Each flow opening 4 is closed by a thin wall comprising a closure 5 which is readily penetrable and may for example be of heavy metal foil. Each closure 5 is independent of the other closures 5 so that the rupture of one closure 5 will not disturb the other closures 5.

A closure in the form of a valve disc 6 is carried by a screw 7 that has screw-threaded engagement with a central opening through the bung and which may be rotated to move disc 6 into and out of sealing engagement with all of the flow openings 4. The open condition is shown in FIG. 1; and in closed condition, the annular sealing surface 8 of the bung body is tightly contacted by the sealing ring 9. A washer 10 carried by a rivet 11 at the end of screw 7 secures disc 6 thereto.

To use the bung of the present invention, it is screwed into the filled container and all of the closures 5 are maintained intact. When it is desired to dispense from the container, the container is tilted and one closure 5 is ruptured. The closure 5 selected for rupture is that which is lowermost in the tilted position of the container. The screw 7 can then be rotated to move disc 6 awway from its seat on the bung body, to the FIG. 1 position, whereupon the contents of the container flow out through only the lowermost flow opening 4 with its ruptured closure 5. The intact closures 5 prevent the liquid from flowing out of any other flow opening.

When dispensing has been completed, the screw 7 can be rotated in the reverse direction to close disc 6 against the bung body to shut off the flow of liquid. As the screw 7 is axial of the bung and the open flow opening 4 is below that axis, the opening and closing of disc 6 can be performed with a tool such as a screwdriver without the contents of the container flowing over the tools or the hands of the operator.

If desired, the closures 5 can be rendered more readily frangible by providing weakening grooves along the edges thereof.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described our invention, we claim:

1. A bung for containers comprising an externally screw-threaded body having a plurality of flow openings therethrough arranged in a series about the axis of the bung, a valve for simultaneously opening and closing all of the flow openings, a thin penetrable closure closing each flow opening and being so disposed that the closure of any opening can be penetrated without penetrating the closure of any other opening, and a valve operator lying on the axis of said body and movable relative to said body to move said valve to open and close said flow openings, said flow openings surrounding said valve operator.

2. A bung as claimed in claim 1, said valve being a disc and said valve operator carrying said disc.

3. A bung as claimed in claim 2, said valve operator being a screw coaxial with said body.

4. A bung as claimed in claim 1, said body being substantially thicker in an axial direction than said closures.

* * * * *